US008985320B2

(12) United States Patent
Santarelli

(10) Patent No.: US 8,985,320 B2
(45) Date of Patent: Mar. 24, 2015

(54) EYEGLASSES CASE

(71) Applicant: Fortuna Urbis Srl, Rome (IT)

(72) Inventor: Paola Santarelli, Rome (IT)

(73) Assignee: Fortuna Urbis Srl, Rome (IT)

( * ) Notice: Subject to any disclaimer, the term of this patent is extended or adjusted under 35 U.S.C. 154(b) by 0 days.

(21) Appl. No.: 14/360,782

(22) PCT Filed: Oct. 31, 2012

(86) PCT No.: PCT/IB2012/056051
§ 371 (c)(1),
(2) Date: May 27, 2014

(87) PCT Pub. No.: WO2013/076604
PCT Pub. Date: May 30, 2013

(65) Prior Publication Data

US 2014/0305814 A1 Oct. 16, 2014

(30) Foreign Application Priority Data

Nov. 25, 2011 (EP) ..... 11190846

(51) Int. Cl.
*A45C 11/04* (2006.01)

(52) U.S. Cl.
CPC ..... *A45C 11/04* (2013.01)
USPC ..... 206/5

(58) Field of Classification Search
USPC ..... 206/5, 6, 320, 701
See application file for complete search history.

(56) References Cited

U.S. PATENT DOCUMENTS

| | | | | |
|---|---|---|---|---|
| 6,164,442 | A * | 12/2000 | Stravitz | 206/233 |
| 6,693,537 | B2 * | 2/2004 | Frank | 340/568.1 |
| 6,851,552 | B1 * | 2/2005 | Chao | 206/5 |
| 8,567,649 | B1 * | 10/2013 | Cabak | 224/312 |
| 8,818,464 | B2 * | 8/2014 | Olsson et al. | 455/575.1 |
| 2005/0242771 | A1 | 11/2005 | Blum et al. | |
| 2007/0281752 | A1 * | 12/2007 | Lewis | 455/569.1 |
| 2014/0185003 | A1 * | 7/2014 | Waters | 351/158 |

FOREIGN PATENT DOCUMENTS

| | | | |
|---|---|---|---|
| CN | 201995802 | U | 10/2011 |
| DE | 102009011005 | A1 | 9/2010 |

OTHER PUBLICATIONS

International Search Report for PCT/IB2012/056051 dated Jun. 21, 2013.

* cited by examiner

*Primary Examiner* — Jacob K Ackun
(74) *Attorney, Agent, or Firm* — Heslin Rothenberg Farley & Mesiti P.C.; Victor A. Cardona, Esq.

(57) ABSTRACT

A case for eyeglasses provided with at least one integrated electrical or electronic device supplied by at least one rechargeable battery. The case incorporates a battery charger configured for charging the rechargeable battery when the eyeglasses are inserted in the case.

4 Claims, 3 Drawing Sheets

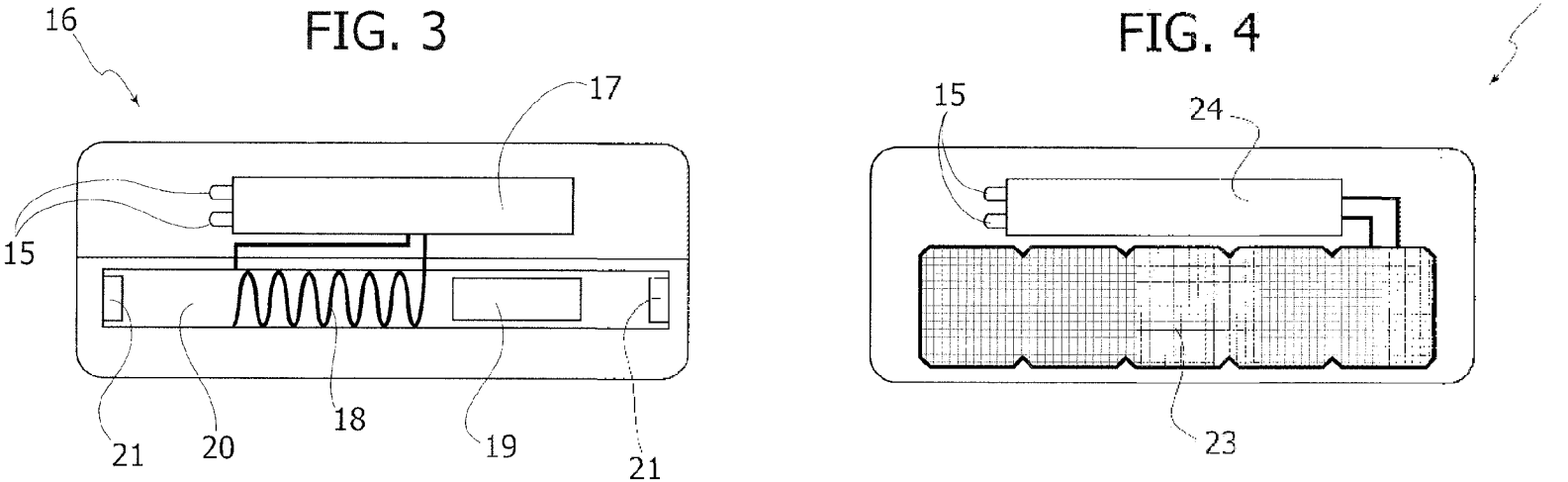
FIG. 4
FIG. 3
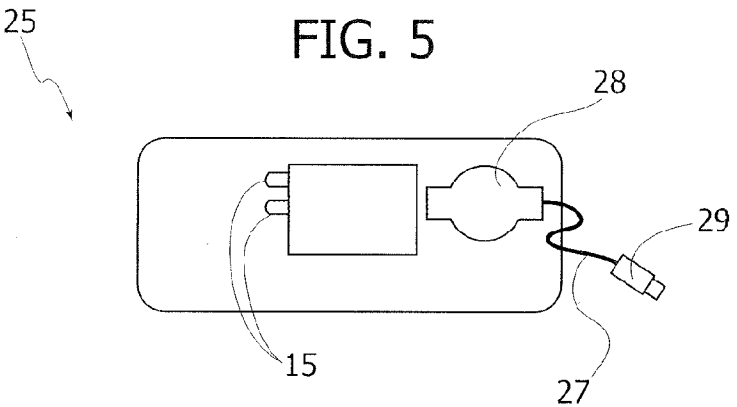
FIG. 5

EYEGLASSES CASE

CROSS REFERENCE TO RELATED APPLICATIONS

This application is a National Stage of PCT International Application No. PCT/IB2012/056051, filed on Oct. 31, 2012, and published in English on May 30, 2013 as WO 2012/076604 A2, which claims priority from European patent application Ser. No. 11190846.3 filed on Nov. 25, 2011, the entire disclosures of which are incorporated herein by reference.

FIELD OF THE INVENTION

The present invention relates in general to eyeglasses, in particular albeit not exclusively of the compact type with graduated lenses for reading, and more in particular regards a case for eyeglasses of the above sort.

PRIOR ART

Known to the art are eyeglasses provided with at least one electrical or electronic integrated device supplied via at least one battery, which is also incorporated in the eyeglasses. The integrated device can consist, for example, of light sources designed to emit light in front of the eyeglasses to enable the user to read also in poorly illuminated environments, as described and illustrated in the European patent applications Nos. 11187743.7 and 11187752.8 filed in the name of the present applicant (not published at the date of filing of the present application), which moreover envisage electromechanical or electronic control means for fading automatically the intensity of the light emitted when, in use, the eyeglasses are moved angularly upwards with respect to a reference position.

The electrical or electronic device integrated in the eyeglasses can also include a voice-recognition sensor to enable the user to locate easily the eyeglasses in the case of their being mislaid, as described and illustrated in the aforesaid two patent applications as well as in the European patent application No. 11187758.5 (not published at the date of filing of the present application), which is also filed in the name of the present applicant.

In these embodiments there arises the problem, when the battery runs down, of having to take it out of the eyeglasses to be able to recharge it using a conventional battery charger, or else to replace it.

US-2005/242771A1 and CN-201995802U disclose eyeglasses cases incorporating a battery charger configured for recharging a rechargeable battery of the eyeglasses when these are inserted in the case.

SUMMARY OF THE INVENTION

The object of the present invention is to prevent the need to extract the battery or batteries from the eyeglasses when it is necessary to recharge it or them, and said object is achieved by a combination of eyeglasses and eyeglasses case as set forth in claim 1.

The invention envisages various alternative, or also combined, solutions, for providing the battery charger incorporated in the case, and in particular of a dynamic type, of a solar type, and of the cable type with USB plug connector.

BRIEF DESCRIPTION OF THE DRAWINGS

The invention will now be described in detail with reference to the annexed drawings, which are provided purely by way of non-limiting example, and in which:

FIGS. 3, 4 and 5 are three diagrams that show respective variants of the battery charger incorporated in the case of FIG. 2.

DETAILED DESCRIPTION OF THE INVENTION

The eyeglass case according to the invention is expressly provided for accommodating eyeglasses equipped, as has been said, with at least one integrated electrical or electronic device, supplied by at least one rechargeable battery, which is also incorporated inside the eyeglasses.

Figure 1:
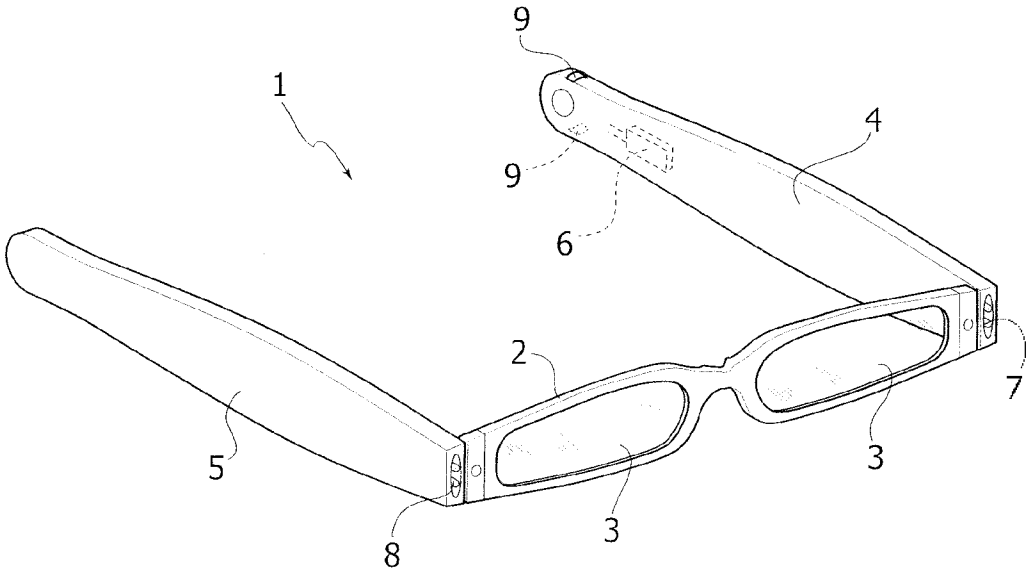
FIG. 1 is a schematic perspective view that shows an example of eyeglasses that can be used with the case according to the invention, represented with the arms in an extended condition.
Figure 1A:
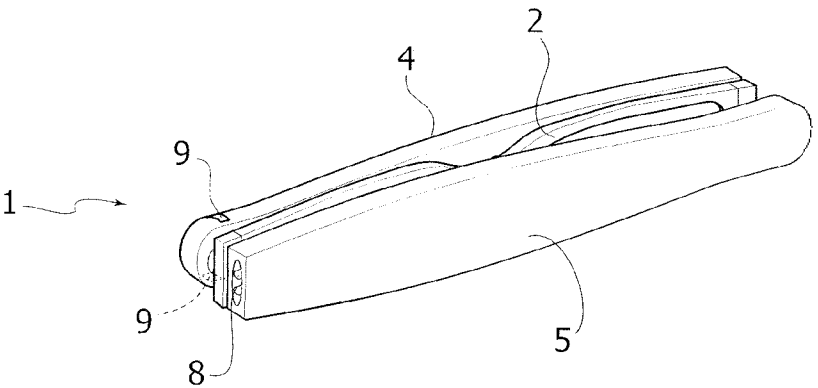
FIG. 1A is a view similar to FIG. 1 that shows the arms in the folded condition.

A possible example of eyeglasses of the above sort is represented in FIGS. 1 and 1A, merely by way of absolutely non-limiting example. These eyeglasses, designated as a whole by 1 in the drawings, are similar to the ones described in the aforesaid European patent applications filed in the name of the present applicant No. 11187758.5, as regards the general conformation of the eyeglasses and the structures for folding its arms, as well as the corresponding accompanying electrical devices, and Nos. 11187752.8 and 11187743.7, as regards the provision, respectively, of a further electromechanical device and a further electronic device. Of course, both the general conformation of the eyeglasses and the characteristics of the corresponding electrical or electronic devices integrated therein may differ widely from what is illustrated and described hereinafter.

The eyeglasses 1 comprise in a generally conventional way a front 2 bearing a pair of lenses 3 and a pair of arms 4, 5 articulated at the sides of the front and able to turn between the extended position of use represented in FIG. 1, in which they extend substantially in a direction orthogonal to the front 2, and the folded position represented in FIG. 1A. In the case of the example illustrated, in said folded position the arm 4 is set against the rear side of the front 2, whilst the arm 5 is set against its front side in such a way that the lenses 3 are protected on both faces.

The eyeglasses 1 incorporate a front-lighting electrical device, provided in particular for enabling the user to read in conditions of poor lighting. The lighting system includes, for example, two pairs of LEDs (light-emitting diodes) 7, 8 surfacing from the ends for articulation of the arms 4, 5 to the front 2 and arranged and oriented so as to generate a relatively wide light beam.

Activation and the de-activation of the LEDs 7, 8 is provided, by means of a switch (not illustrated) with possible associated regulator of intensity, via a circuit incorporated in one and/or the other arm 4, 5 and including at least one rechargeable battery indicated with a dashed line and designated by 6, inserted, for example, within a compartment of the arm 4, and an electronic control card, which can incorporate an anti-dazzle device provided for varying automatically the intensity of the light emitted by the LEDs 7, 8 when, in use, the eyeglasses are moved angularly upwards with respect to an angular reference position. The characteristics of the anti-dazzle device can be of the type described and illustrated in the aforesaid European patent applications Nos. 11187743.7 and 11187752.8 filed in the name of the present applicant.

Figure 2:
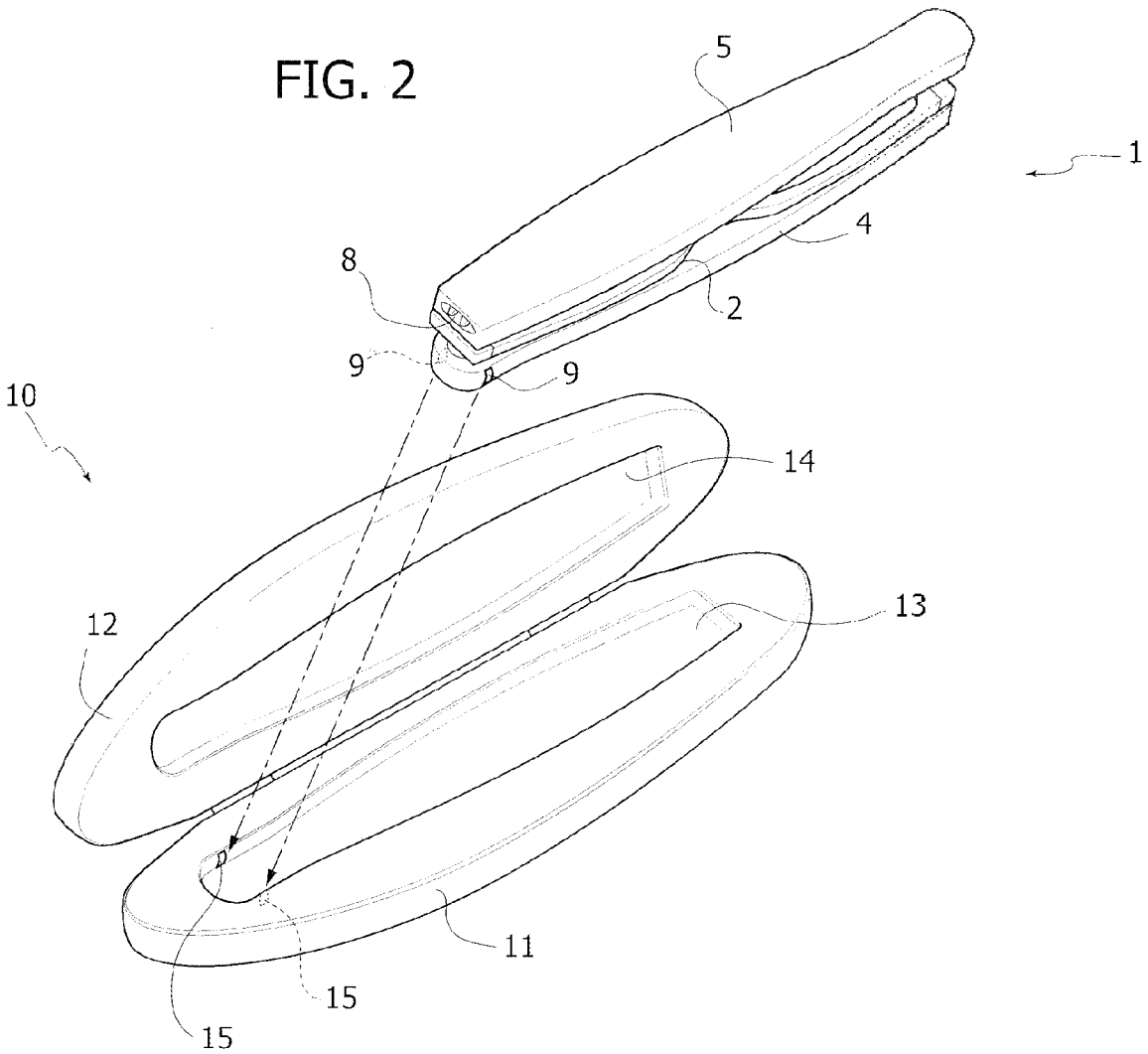
FIG. 2 is a schematic perspective view that shows the case according to the invention during the step of insertion therein of the eyeglasses represented in FIGS. 1 and 1A.

The rechargeable battery 6 is electrically connected to a pair of contacts 9, which surface from the arm 4 and via which said battery 6 can be recharged directly with the aid of the case according to the invention, designated as a whole by 10 in FIG. 2.

It should be noted that the shape, configuration, and arrangement of the parts of the case that will be described hereinafter are also in this case provided merely by way of non-limiting example.

In the example illustrated, the case 10 is formed by two half-shells 11, 12 articulated to one another so as to open like a book, each of which has a respective recess 13, 14 designed to define a receptacle for accommodating the eyeglasses 1 in the configuration where the corresponding arms 4, 5 are folded, once again represented in FIG. 2. As is indicated in said figure, the arrangement of the case receptacle is such that, when the eyeglasses 1 are inserted in the recess 13 of the half-shell 11, the contacts 9 that surface on the arm 4 come to correspond and mate precisely and closely with a pair of corresponding contacts 15 carried by the half-shell 11 and operatively connected to a battery charger incorporated in the case 10 and provided for recharging the battery 6.

The battery charger can present one of three alternative configurations represented, respectively, in FIGS. 3, 4 and 5, or else combinations of two of them or even of all of them.

The first configuration, represented schematically in FIG. 3, consists in a battery charger 16 of a dynamic type. The contacts 15 are connected to an electronic card 17, which is in turn connected to a winding 18 through which a permanent magnet 19 can translate axially, sliding with alternating rectilinear motion within a guide 20 set at the ends of which are two springs designated as a whole by 21. When the case 10 containing the eyeglasses 1 is moved longitudinally in one direction and in the opposite direction, the magnet 19 displaces alternately through the winding 18, aided in the changes of direction by the two springs 21. Produced across said winding 18 is an a.c. signal, which, via the electronic card 17, is conditioned and used for recharging the battery 6 through the contacts 9 and 15.

By way of example, the electromagnetic system described above could be of the type marketed by ENOCEAN GmbH under the trade name ECO 100. Once again by way of example, management of the energy produced by the electromagnetic system of the dynamic battery charger and consequent management of charging may be carried out via a diode rectifier, capacitors, and a charging system marketed by LINEAR TECHNOLOGY CORPORATION under the trade name LTC4071.

The solar-system battery charger, designated as a whole by 22 in FIG. 4, comprises a set of photovoltaic cells 23 applied on the outer surface of the case 10 and connected to an electronic card 24 altogether similar to the electronic card 17 of the dynamic system 16, or even constituted by the electronic card 17 itself where the case 10 envisages both the dynamic system 16 and the solar system 22.

By way of example, the photovoltaic cells 23 could be of the type marketed by IXYS Korea Ltd. with the code SLMD481H08, and management of the energy produced by said photovoltaic cells 23 and consequent management of charging of the battery 6 may be implemented via a converter of the LTC3105 type manufactured by LINEAR TECHNOLOGY CORPORATION and a charging system of the LTC4070 type likewise manufactured by LINEAR TECHNOLOGY CORPORATION, provided on the electronic card 24.

The cable battery charger, designated as a whole by 25 in FIG. 5, comprises an electronic card 26 connected to the contacts 15 and connected to which is a cable 27 with associated winder 28, provided with a USB micro-connector 29 that can be connected to the USB port of a personal computer or else, alternatively, of a power supply of the type provided along with cellphones that can be in turn connected to a mains-supply socket.

Management of the energy supplied by the personal computer or by the mains supply and consequent management of charging of the battery 6 may be implemented via a charging system of the type LTC4070 manufactured by LINEAR TECHNOLOGY CORPORATION on the electronic card 26.

Also the cable system 25 may coexist with the dynamic system 16 and/or with the solar system 22.

Of course, the details of construction and the embodiments of the eyeglass case may, as has already been said, vary widely with respect to what is described and illustrated herein, without thereby departing from the scope of the present invention as defined in the ensuing claims.

The invention claimed is:

1. A combination of eyeglasses and a case for the eyeglasses, wherein the eyeglasses are provided with at least one integrated electrical or electronic device supplied by at least one rechargeable battery, and wherein said case incorporates a battery charger configured for charging said rechargeable battery when the eyeglasses are inserted in the case, said battery charger being operatively connected to exposed contacts within the case that are configured for co-operating with complementary eyeglass contacts carried by the eyeglasses and connected to said at least one battery, wherein said contacts of the eyeglasses are situated on a surface of an arm of articulated arms of the eyeglasses the case is formed with a receptacle for accommodating the eyeglasses in a configuration where the arms are folded, said receptacle being defined by two respective recesses of half-shells, having a shape complementary to that of the eyeglasses and configured for setting the contacts of the eyeglasses in a position corresponding to the contacts of the case, wherein said exposed contacts of the case are arranged at opposite side walls of one recess of the recesses.

2. The case according to claim 1, wherein said battery charger is of a dynamic type including a winding, which is connected to an electronic control card and through which a permanent magnet can move with alternating motion.

3. The case according to claim 1, wherein said battery charger is of a solar type including photovoltaic cells applied on an outside of the case and connected to an electronic control card.

4. The case according to claim 1, wherein said battery charger is of the cable type with winder and USB connector connected to an electronic control card.

* * * * *